US007602282B2

(12) United States Patent
Martin et al.

(10) Patent No.: US 7,602,282 B2
(45) Date of Patent: Oct. 13, 2009

(54) AUDIO SYSTEM END OF LINE LOAD MODULE PROVIDING A LOAD ON THE AUDIO CIRCUIT IN RESPONSE TO A TEST SIGNAL

(75) Inventors: Hardison G. Martin, Louisville, KY (US); Robert A. Ponto, Louisville, KY (US)

(73) Assignee: Innovative Electronic Designs, Inc., Louisville, KY (US)

( * ) Notice: Subject to any disclaimer, the term of this patent is extended or adjusted under 35 U.S.C. 154(b) by 345 days.

(21) Appl. No.: 11/638,912

(22) Filed: Dec. 14, 2006

(65) Prior Publication Data

US 2008/0144845 A1 Jun. 19, 2008

(51) Int. Cl.
*G08B 29/00* (2006.01)

(52) U.S. Cl. ..... 340/506; 340/635; 381/82

(58) Field of Classification Search ..... 340/635, 340/506, 510; 381/77, 80, 82
See application file for complete search history.

(56) References Cited

U.S. PATENT DOCUMENTS 6,462,653 B1 * 10/2002 Scorfield et al. ..... 340/506
2006/0182288 A1 * 8/2006 Arcaria et al. ..... 381/82
2007/0085694 A1 * 4/2007 Larkin ..... 340/650

OTHER PUBLICATIONS

NFPA 72, National Fire Alarm Code, 2007 Edition, effective Aug. 17, 2006—p. 1 and other selected portions of document attached—4 pages.
UL 864, Control Units and Accessories for Fire Alarm Systems, ISBN 0-7629-0795-9, Jul. 14, 2005, p. 1 and section 19.1 attached—2 pages.

* cited by examiner

*Primary Examiner*—Jeffery Hofsass
(74) *Attorney, Agent, or Firm*—James C. Eaves, Jr.; Greenebaum Doll & McDonald PLLC

(57) ABSTRACT

An end-of-line module provided at the end of the line of an audio circuit provides a load in response to a test signal. The load is detectable by an announcement control system so that a fault indication may be triggered in the event the announcement control system does not sense the end-of-line module as being connected to the audio circuit and detects an interruption in the audio circuit. In addition, the end-of-line module may include an over-temperature sensor or protection device to prevent the audio circuit from exceeding a predetermined limit, for example, a temperature level assigned to insure compliance with fire, safety and other standards or specifications. A fault or other indication may be reported to or sensed by the announcement control system and may be further processed in a manner appropriate for the application and/or facility having the announcement control system.

29 Claims, 3 Drawing Sheets

AUDIO SYSTEM END OF LINE LOAD MODULE PROVIDING A LOAD ON THE AUDIO CIRCUIT IN RESPONSE TO A TEST SIGNAL

BACKGROUND

The invention generally relates to audio/video management systems, including announcement control systems. More particularly, the invention relates to an electronic end-of-line module used in audio/video management systems to facilitate testing, monitoring and detection in such systems. Publicly accessible areas are often equipped with broadcasting systems having both audio and video components for disseminating information to the general public. For example, museums, stadiums, casino and other resorts, hospitals, theme parks, factories, military installations, shopping centers, train stations, bus stations, airports, and smaller facilities, including grocery stores, have audio/video announcement systems. Announcement control systems may include, for example, the following components or sub-systems, monitoring and testing, DSP (digital signal processing) processing, power amplification, backup, computerized communications, and flight, courtesy, and/or visual announcement systems. Moreover, an announcement control system may receive inputs from devices such as microphones, telephones, and music sources and may be integrated, to varying degrees, with other networked or stand-alone systems, e.g., fire alarm system, either directly or by use of a network switching device.

In transportation centers, automated and real-time audio announcements are a necessity for informing travelers of arrival and departure times, paging messages, emergency announcements, gate or terminal changes, and a host of other messages necessary to facilitate efficient travel. It is essential that audio delivery equipment, such as speakers, audio input/output control, processing and distribution equipment, and associated wiring, are in proper working order to insure travelers and other persons of interest, depending on the facility, are effectively informed of important information. For example, when a flight schedule is modified, a video display device displaying information for multiple flights will often simply change the affected flight information on the display. Often, a concomitant audio announcement is made to inform passengers that a particular flight has been affected. Additionally, in many cases courtesy and emergency announcements or messages are broadcast only through the audio portion of the system, as most display systems are not equipped to visually display courtesy announcements.

Because facilities, such as airports, may be large and may consist of multiple buildings, areas, zones or segments, such as terminals, maintaining integrity of audio systems presents challenges. Complicating the task of maintaining system integrity is that system devices, such as speakers, wiring and other networking infrastructure, including end-of-line modules, are often concealed behind or above ceilings, walls and other structures. In addition, facilities such as those mentioned above are often subject to strict fire, safety and other regulatory codes and provisions. This requires that devices and wiring used in announcement control and delivery systems meet all applicable fire and safety codes and standards, e.g., NFPA (National Fire Protection Association) standards (NFPA 72) and UL (Underwriters Laboratory) (UL864) standards.

One conventional method of monitoring system integrity is to run a separate test signal wire in addition to a primary signal wire in a return loop configuration. The system transmits a test signal on the test signal wire and monitors the return of the test signal on the return portion of the test loop circuit. Alternatively, the primary signal wire, used primarily to deliver audio signal to speakers, may be used to carry a test signal that is transmitted through the primary audio signal wire. However, a return wire or circuit must be provided to return the test signal to the system for monitoring and to confirm circuit integrity. If the system does not receive the test signal on the return side of the loop circuit, then a fault condition arises indicating that the test signal did not return and that a possible wire interruption, such as a "cut" or disconnected wire, has occurred. One problem with this approach is that often false faults arise due to the test signal wire being interrupted or disconnected rather than the primary signal wire being interrupted. Often, users may ignore the "false" fault because they continue to hear audio being delivered through some or all of the speakers. This results in a sense that the system is unreliable and that fault indications may be ignored. In addition, the return wire adds to the cost of the system and complication in the wiring scheme.

SUMMARY OF THE INVENTION

The instant invention overcomes the aforementioned problems by providing an end-of-line (EOL) module and system and method for more efficiently broadcasting a primary audio signal along with transmitting a system test signal for monitoring and testing system operation. The EOL module may by circuit made up of a combination of resistance, capacitance, and/or inductance elements so as to provide a load on the circuit to which it is connected at the "end of the line" or at the end of the wired circuit. The load, measured for example in ohms, is preferably greater than the load associated with all speakers connected to the circuit to which the EOL module is connected. A test signal may be periodically transmitted through the audio circuit connecting the speakers or other audio delivery components to ultimately reach the EOL module. So as to not introduce undesirable noise on the audio delivery circuit, the test signal is preferably at a high enough frequency so as to not be noticeable to the human ear. In one example, the test signal may be at or about 20 kHz.

The announcement control system can detect the presence of the EOL module load, and therefore the presence of the EOL module, on the circuit. If the system does not detect the presence of the EOL module on the circuit, then the system may process the information and generate a fault condition or other indication. The fault condition would indicate that the EOL module is no longer connected to the circuit and that one or more speakers may likewise not be connected to the circuit. Because the test signal is carried on the same audio circuit as the primary audio signal, the invention eliminates the need for a separate test wire and a loop configuration back to the system.

In keeping with the instant invention, a test signal transmitted through the audio circuit at a predetermined frequency causes a response in the EOL module so as to place a detectable load on the audio circuit. In addition, the EOL module load may elevate the temperature of the primary audio circuit or wire. Under some conditions and designs it may be possible to maintain indefinitely or for undetermined periods of time a test signal on the circuit. Under other conditions it may be undesirable to maintain beyond a certain duration the test signal on the audio circuit to avoid heating of the audio circuit beyond a safe or recommended temperature due to the RC load. The EOL module of the present invention is configured so that 1) it is detectable with a test signal of a given frequency, and 2) it does not place such a load on the circuit to cause excessive heating of the circuit given the duration and frequency of the test signal. NFPA 72 sets forth the periodicity of test signals, i.e., requires that an announcement control system test audio circuits every so often to confirm system operation and integrity. To be in compliance with NFPA 72, for example, the system is required to run a test signal at least every 180 seconds. Also, Underwriters Laboratories, for example, may require that wiring in a facility not exceed a threshold temperature, e.g., 105 degrees C. Accordingly, in one example the EOL module should be configured to provide a detectable load in response to a test signal of about 20 kHz transmitted every 180 seconds while preventing the temperature of the circuit from exceeding 105 degrees C.

The EOL module of the present invention may optionally be provided with an over-temperature protection device or circuit to interrupt current flow through the circuit in the event of an unsafe condition or to insure compliance with prevailing standards. For example, a thermistor, pre-thermistor, temperature switch, fuse, diode or other suitable device may be included to detect the temperature of the circuit and to break the circuit at a predetermined level. If the prevailing standard sets forth a maximum permissible wire temperature of 105 degrees C., for example, then the over-temperature protection device may be set to break the circuit upon detecting or sensing a temperature at or slightly or somewhat below the maximum, i.e., at or below 105 degrees C.

In one embodiment, the invention may be used in an announcement control system having a central announcement database server connected to one or more operator workstation computers and may be linked by a digital communications network to an audio broadcast system having a plurality of audio speakers capable of broadcasting audible information throughout a given facility. A plurality of speakers or other sound reproduction devices, which may be segregated into groups, are connected to an audio controller for broadcasting audio messages to a plurality of locations, or even to a plurality of pre-defined broadcast zones within a facility.

Therefore, it is an object of the present invention to provide a system and method for broadcasting audible information while simultaneously providing a testing arrangement to confirm system operation.

It is a further object of the invention to provide a testing arrangement using an audio circuit whereby the testing is inaudible to the human ear and does not interfere with the delivery of audible information.

It is a further object of the invention to provide an end of line module at the end of an audio circuit, the module being responsive to a test signal to enable an ACS to detect the presence of the EOL module and integrity of the audio circuit.

It is a further object of the invention to optionally provide an over-temperature protection device to prevent the EOL module from over-heating the audio circuit to which it is connected.

It is a further object of the invention to provide a testing arrangement capable of allowing other testing schemes to be conducted in conjunction with system operation.

Other objects and advantages of the instant invention will be apparent after reading the detailed description of the preferred embodiments, taken in conjunction with the accompanying drawing figures.

In one embodiment, the instant invention provides an end-of-line (EOL) module for use in an announcement control system (ACS) having at least one output electrically connected to an audio circuit for delivering an audio signal. The audio circuit includes serially connected audio devices, such as speakers, that deliver audio information. The EOL module includes at least one resistive element, at least one capacitive element and at least one inductive element and is connected at the end of the audio circuit after the last audio device. The EOL module provides a load on the audio circuit in response to a signal carried on the audio circuit. The EOL module load is detectable by the ACS to detect the presence of the EOL module in the circuit. The embodiment may further include an over-temperature protection device, for example a thermistor, a temperature-sensitive switch, a fuse, or a diode. The over-temperature protection device prevents the temperature of the circuit from exceeding a predetermined temperature, e.g., a temperature falling in the range of 95 degrees C. to 105 degrees C.

More particularly, in the embodiment the EOL module provides a load in response to a test signal generated by the ACS and transmitted to the audio circuit to allow the ACS to detect the presence of the EOL module on the audio circuit. The test signal may be at a frequency that is essentially unintelligible to the human ear, e.g., at a frequency within the range of 19 kHz to 25 kHz. The test signal may be transmitted periodically, e.g., at least once every 180 seconds, and may be less than twenty seconds in duration. Upon the EOL module becoming disconnected from the audio circuit, the ACS may detect the absence of the EOL module and an interruption in the audio circuit and may generate a fault indication. The EOL module load is greater than a load associated with the plurality of audio devices, which may be comprised of speakers.

In another embodiment, the present invention provides an announcement control system (ACS) for managing the delivery of audio content at a facility. The ACS includes an amplification system having at least one input for receiving audio content and at least one output for delivering an audio signal and a test signal. The ACS further includes an audio circuit electrically connected to the audio output for delivering the audio signal and the test signal. The ACS further includes a plurality of audio devices serially connected along the audio circuit for producing audible information representative of the audio signal. The ACS further includes an end-of-line (EOL) module connected at the end of the audio circuit after the last audio device. Upon the ACS generating the test signal on the audio circuit, the EOL module provides a load on the audio circuit that is detectable by the ACS, whereby the ACS detects the presence of the EOL module in the circuit. In another embodiment, the present invention provides a method for testing the integrity of an audio circuit comprising a plurality of serially connected audio devices. The method includes the steps of: generating a test signal at a predetermined frequency, the frequency being at a level so that the test signal is essentially unintelligible to the human ear; transmitting the test signal along an audio circuit to be tested; placing an end-of-line (EOL) module at the end of the audio circuit after the last audio device; providing a load on the audio circuit by the EOL module in response to the test signal; and detecting the EOL module load to detect the presence of the EOL module in the circuit. The method may further include the step of detecting the temperature of the circuit and preventing the circuit from exceeding a predetermined temperature.

BRIEF DESCRIPTION OF THE DRAWINGS

The benefits, features, and advantages of the present invention will become better understood with regard to the following description, and accompanying drawings in which.

DETAILED DESCRIPTION OF THE PREFERRED EMBODIMENT

The following description is presented to enable one of ordinary skill in the art to make and use the present invention as provided within the context of a particular application and its requirements. Various modifications to the preferred embodiment will, however, be apparent to one of ordinary skill in the art, and the general principles defined herein may be applied to other embodiments. Therefore, the present invention is not intended to be limited to the particular embodiments shown and described herein, but is to be accorded the widest scope consistent with the principles and novel features herein disclosed.

Figure 1:
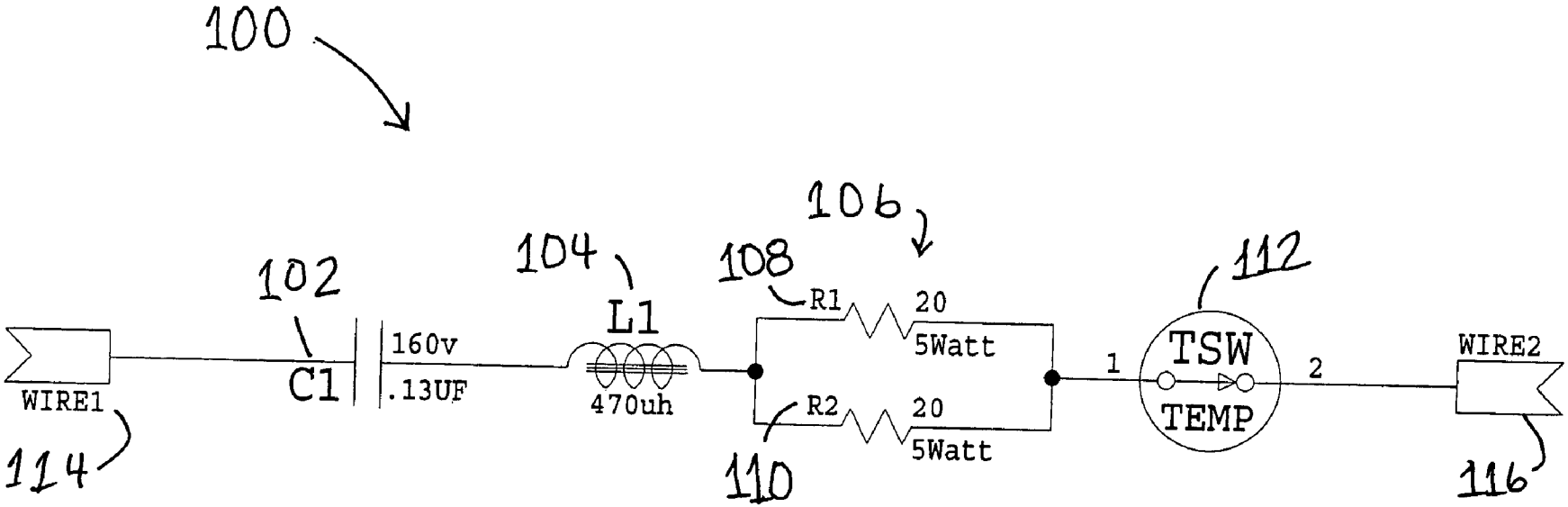
FIG. 1 is a schematic diagram showing one embodiment of the EOL module of the present invention.

The instant invention provides an end-of-line (EOL) module and system and method for more efficiently broadcasting an audio signal along with transmitting a system test signal for monitoring and testing system operation. With reference to FIG. 1, an EOL module 100 includes a capacitor C1 102, an inductor L1 104, a resistor pair 106, made up of resistor R1 108 and resistor R2 110, and an over-temperature protection device 112. The EOL module 100 is connected at respective ends to wire1 114 and wire2 116.

Figure 2:
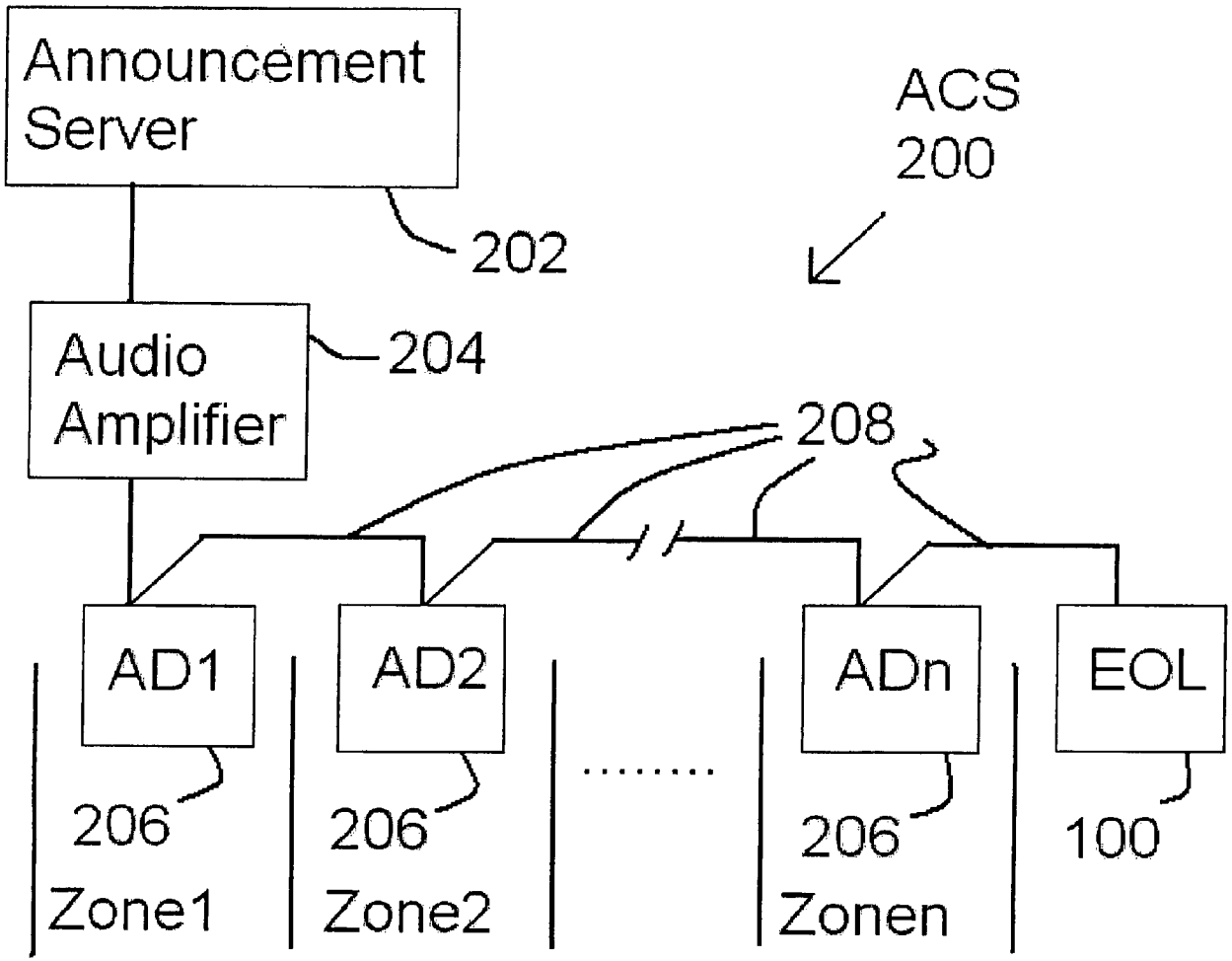
FIG. 2 is a block diagram of an announcement control system incorporating the instant invention and illustrating a wiring configuration in accordance with the instant invention.

With reference to FIG. 2, an exemplary embodiment of the present invention is incorporated in an announcement control system (ACS) 200, for example a 500ACS system or IED 8000 system, both available from Innovative Electronic Designs, Inc. of Louisville, Ky. The ACS 200 provides broadcasting of audio announcements and includes an announcement message server 202 for receiving, routing, assembling, storing and otherwise processing announcements to be broadcast. ACS 200 may include software, hardware or more typically a combination of hardware and software. ACS 200 also includes an amplification system 204 for delivering audio content to a plurality of serially connected audio devices 206, such as speakers or other audio reproduction devices. The EOL module 100 is connected at the end of the audio circuit 208 after the last audio device 206.

The audio circuit 208 delivers an audio signal to the audio devices 206 for delivering audio information, such as flight announcements, traveler alerts, flight changes, and music, to one or more individual zones, e.g., Zone1, Zone2 . . . Zonen. The audio circuit 208 is typically comprised of wires. The term wire is used broadly to refer to physical cabling or other physical medium over which signals are transmitted. It is understood that depending upon the amplification and speaker characteristics, particular type or gauge of wire may be required. The invention is not dependent upon the wiring used in the ACS 200 or the audio circuit 208. Audio devices 206 may be located throughout a facility in order to broadcast messages to a plurality of discrete locations, zones or rooms, as is well known to one of ordinary skill in the art. While the examples referred to in this specification may refer to the use of the present invention in an airport environment, one of ordinary skill will recognize that the present invention may be practiced in a wide variety of venues and wherever it is desirable to broadcast audio announcements.

In addition to broadcasting audio signals, the ACS 200 generates a test signal that is transmitted through the audio circuit 208 at a predetermined frequency. The test signal causes a response in the EOL module 100 so as to place a load on the audio circuit 208 that is detectable by the ACS 200. Under some conditions and designs it may be possible to maintain indefinitely or for unrestricted periods of time the test signal on the circuit 208. However, the load of EOL module 100 may elevate the temperature of the audio circuit 208 and it may be necessary to limit the duration of the test signal to avoid heating the audio circuit beyond a safe or recommended temperature. The EOL module 100 of the present invention is configured so that 1) it is detectable with a test signal of a given frequency, and 2) it does not place such a load on the circuit 208 as to cause excessive heating of the circuit given the duration and frequency of the test signal. NFPA 72 sets forth the periodicity of test signals, i.e., requires that an announcement control system test audio circuits every so often to confirm system operation and integrity. To be in compliance with NFPA 72, for example, the ACS 200 is required to run a test signal at least every 180 seconds. Also, Underwriters Laboratories, for example, may require that wiring in a facility not exceed a threshold temperature, e.g., 105 degrees C. Accordingly, in one example the EOL module 100 should be configured to provide a detectable load in response to the test signal transmitted by the ACS 200 along audio circuit 208 every 180 seconds while preventing the temperature of the circuit 208 from exceeding 105 degrees C.

With reference to the exemplary embodiment of FIG. 1, capacitor 102 has a value of 0.13 micro-farads and is rated for 63 Vdc and to withstand 160 Vdc from a low frequency 100 volt amplifier. The inductor 104 has a rating of 470 microhenrys and resistors 108 and 110 each have a rating of 5 watts and 20 ohms. The wires 114 and 116 are rated at 18 AWG. With reference to FIG. 2, a test signal is periodically transmitted through the circuit 208 to the audio devices 206 and ultimately to the EOL module 100. So as to not introduce undesirable noise on the audio circuit 208, the test signal is preferably at a high enough frequency so as to not be noticeable to the human ear. In this example, the test signal is a 20 kHz tone signal applied for 10 seconds along the audio circuit 208 at a maximum rating of 7 Vrms. The test signal, for example, is 20 dB below a full output given a 70 volt amplifier 204. The test signal is applied at least every 180 seconds and may be applied more often or even continuously provided the temperature of audio circuit 208 does not exceed 105 degrees C., for example. At this level, the test signal would have no effect on other testing at levels such as 1000 Hz.

In this example, the resistance-capacitance-inductance (RCL) circuit of EOL module 100 provides a load on the audio circuit 208. The load, measured for example in ohms, is about 12-15 ohms in this example and is preferably greater than the load associated with all audio devices 206 connected to the circuit 208. At about 15 ohm impedance, the EOL module load causes a large peak in the current at 20 kHz. However, performance below 10 kHz is unaffected. The 15 ohm load is preferable for use in a 70 volt line applications. After transmitting the test signal along audio circuit 208, the ACS 200 can detect the load and presence of the EOL module 100 on the circuit 208. In this example, the EOL module 100 causes a 3 dB peak at 16 kHz. The 20 kHz test drops down 10 dB to 15 dB so long as the circuit 208 is intact. If the circuit 208 becomes severed or open and the EOL module 100 is electrically disconnected, then the voltage level goes up about 10 dB or more and even higher if one or more of the audio devices 206 are also disconnected from the circuit 208.

If the ACS 200 does not detect the presence of the EOL module 100 on the circuit 208, then the ACS may generate a fault condition or other indication, which may be displayed visually or audibly, by lights, sounds, computer screens, control panels, etc. The fault condition would indicate that the EOL module 100 is no longer connected to the circuit 208 and that one or more audio devices 206 may likewise not be connected to the circuit 208 and therefore unable to deliver desired audio content to persons located in the zones or areas covered by the disconnected audio devices. By transmitting the test signal on the audio circuit along with the audio signal, the invention eliminates the need for a separate test wire and a loop configuration back to the ACS 200.

The EOL module 100 may optionally be provided with an over-temperature protection device 112. The over-temperature protection device 112 may take the form of a thermistor or other device to interrupt or limit current flow through the circuit 208 in the event of an unsafe condition or to insure compliance with prevailing standards. For example, a thermistor, a thermal switch, a fuse, a thermal cut-out, or other suitable device may be used to detect the temperature of the circuit 208 and to break the circuit at a predetermined level. In this example a thermal switch from Cantherm of Montreal, Canada model #F1100251ZA0060 is used. In the above example, maximum power at 70 volt at 20 kHz is over 300 watts. If the prevailing standard sets forth a maximum permissible wire temperature of 105 degrees C., for example, then the over-temperature protection device 112 may be set to break the circuit 208 upon detecting or sensing a temperature at or slightly or somewhat below the maximum, i.e., at or below 105 degrees C.

When used in conjunction with the delivery of audio signals, the test signal should be at a frequency that is essentially unintelligible to the human ear, e.g., at a frequency within the range of 19 kHz to 25 kHz. The test signal may be transmitted periodically, e.g., at least once every 180 seconds, and may be less than twenty seconds in duration. In one exemplary embodiment, the ACS 200 manages the delivery of audio content at a facility and includes an amplification system 204 having at least one input for receiving audio content from an announcement server 202 and at least one output for delivering an audio signal and a test signal to audio devices 206 and EOL 100.

Figure 3:
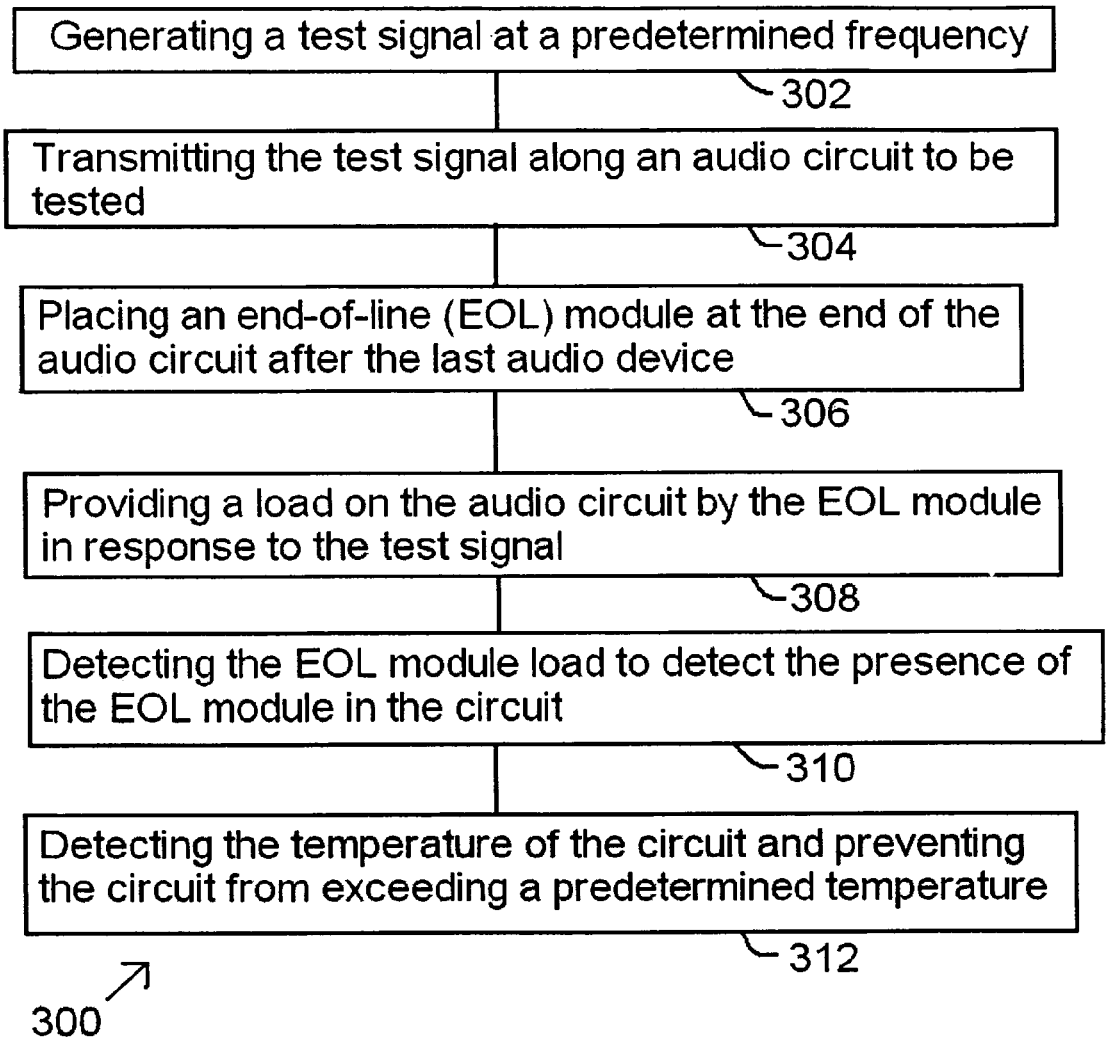
FIG. 3 is a flow chart illustrating the process of the system in accordance with one embodiment of the present invention.

With reference to the flow chart of FIG. 3, the present invention provides a method for testing the integrity of an audio circuit comprising a plurality of serially connected audio devices. The method 300 includes the steps of: generating a test signal at a predetermined frequency 302, the frequency being at a level so that the test signal is essentially unintelligible to the human ear; transmitting the test signal along an audio circuit to be tested 304; placing an end-of-line (EOL) module at the end of the audio circuit after the last audio device 306; providing a load on the audio circuit by the EOL module in response to the test signal 308; and detecting the EOL module load to detect the presence of the EOL module in the circuit 310. The method 300 may further include the optional step of detecting the temperature of the circuit and preventing the circuit from exceeding a predetermined temperature 312.

Optionally, the ACS 200 may include one or more operator workstations electrically connected to the announcement server 202 via a communications network, for example an Ethernet network or any one of a wide variety of commercially available communications networks. The workstation may comprise a conventional personal computer having a microprocessor, a memory, a visual display, and an operator interface, such as a keyboard and a mouse. The workstation may be capable of running conventional web-based browser software such as Internet Explorer® or a similar program and may be adapted to display the ACS 200 fault indications, such as an EOL module disconnect condition. The ACS 200 may include a web-based graphical user interface (GUI) on the workstation. Authorized users or "operators" located at the workstation may login to the ACS 200 with a username and password.

The foregoing detailed description of the exemplary embodiments is considered as illustrative only of the principles of the invention. Since the instant invention is susceptible to numerous changes and modifications by those of ordinary skill in the art, the invention is not limited to the exact construction and operation shown and described, and accordingly, all such suitable changes or modifications in structure or operation which may be resorted to are intended to fall within the scope of the claimed invention.

What is claimed is:

1. An end-of-line (EOL) module for use in an announcement control system (ACS), the ACS having at least one output electrically connected to an audio circuit for delivering an audio signal, the audio circuit comprising a plurality of serially connected audio devices, the EOL module comprising:

at least one resistive element;

at least one capacitive element; and at least one inductive element;

the EOL module being connected at the end of the audio circuit after the last audio device and being adapted to provide a load on the audio circuit in response to a signal carried on the audio circuit;

the EOL module load being detectable by the ACS to detect the presence of the EOL module in the circuit.

2. The EOL module of claim 1 further comprising an over-temperature protection device.

3. The EOL module of claim 2, wherein the over-temperature protection device comprises one of a thermistor, a temperature-sensitive switch, a fuse, or a diode.

4. The EOL module of claim 2, wherein the over-temperature protection device is adapted to prevent the temperature of the circuit from exceeding a temperature falling in the range of 95 degrees C. to 105 degrees C.

5. The EOL module of claim 1, wherein the ACS is adapted to generate a test signal and output the test signal to the audio circuit for use in detecting the presence of the EOL module on the audio circuit.

6. The EOL module of claim 5, wherein the test signal is at a frequency that is essentially unintelligible to the human ear.

7. The EOL module of claim 6, wherein the test signal is at a frequency within the range of 19 kHz to 25 kHz.

8. The EOL module of claim 5, wherein the test signal is transmitted periodically to monitor circuit integrity.

9. The EOL module of claim 5, wherein the test signal is transmitted at least once every 180 seconds.

10. The EOL module of claim 5, wherein the test signal is less than twenty seconds in duration.

11. The EOL module of claim 1, wherein upon the EOL module becoming disconnected from the audio circuit, the ACS detects the absence of the EOL module and an interruption in the audio circuit and generates a fault indication.

12. The EOL module of claim 1, wherein the EOL module load is greater than a load associated with the plurality of audio devices.

13. The ACS of claim 1, wherein the plurality of audio devices are comprised of speakers.

14. An announcement control system (ACS) for managing the delivery of audio content at a facility, the ACS comprising:

an amplification system having at least one input for receiving audio content and at least one output for delivering an audio signal and a test signal;

an audio circuit electrically connected to the audio output for delivering the audio signal and the test signal;

a plurality of audio devices serially connected along the audio circuit for producing audible information representative of the audio signal; and an end-of-line (EOL) module connected at the end of the audio circuit after the last audio device and upon the ACS generating the test signal on the audio circuit, the EOL module being adapted to provide a load on the audio circuit that is detectable by the ACS, whereby the ACS detects the presence of the EOL module in the circuit.

15. The ACS of claim 14, wherein the EOL module comprises at least one resistive element and at least one capacitive element.

16. The ACS of claim 14, wherein the EOL module comprises an over-temperature protection device.

17. The ACS of claim 16, wherein the over-temperature protection device comprises at least one of a thermistor, a temperature-sensitive switch, a fuse, or a diode.

18. The ACS of claim 16, wherein the over-temperature protection device is adapted to prevent the temperature of the circuit from exceeding a temperature falling in the range of 95 degrees C. to 105 degrees C.

19. The ACS of claim 14, wherein the test signal is at a frequency that is essentially unintelligible to the human ear.

20. The ACS of claim 14, wherein the test signal is at a frequency within the range of 19 kHz to 25 kHz.

21. The ACS of claim 14, wherein the test signal is transmitted periodically to monitor circuit integrity.

22. The ACS of claim 14, wherein the test signal is transmitted at least once every 180 seconds.

23. The ACS of claim 14, wherein the test signal is less than twenty seconds in duration.

24. The ACS of claim 14, wherein upon the EOL module becoming disconnected from the audio circuit, the ACS detects the absence of the EOL module and an interruption in the audio circuit and generates a fault indication.

25. The ACS of claim 14, wherein the EOL module load is greater than a load associated with the plurality of audio devices.

26. The ACS of claim 14, wherein the plurality of audio devices are comprised of speakers.

27. A method for testing the integrity of an audio circuit comprising a plurality of serially connected audio devices, the method comprising:

generating a test signal at a predetermined frequency, the frequency being at a level so that the test signal is essentially unintelligible to the human ear;

transmitting the test signal along an audio circuit to be tested;

placing an end-of-line (EOL) module at the end of the audio circuit after the last audio device;

providing a load on the audio circuit by the EOL module in response to the test signal; and detecting the EOL module load to detect the presence of the EOL module in the circuit.

28. The method of claim 27 further comprising detecting the temperature of the circuit and preventing the circuit from exceeding a predetermined temperature.

29. The method of claim 27 further comprising detecting the absence of the EOL module and an interruption in the audio circuit and generating a fault indication upon the EOL module becoming disconnected from the audio circuit.

* * * * *